US010513832B2

(12) United States Patent
Blank

(10) Patent No.: US 10,513,832 B2
(45) Date of Patent: Dec. 24, 2019

(54) PNEUMATIC PILING HAMMER FOR SUBMERSION PILINGS

(71) Applicant: Scott Blank, Naples, FL (US)

(72) Inventor: Scott Blank, Naples, FL (US)

( * ) Notice: Subject to any disclaimer, the term of this patent is extended or adjusted under 35 U.S.C. 154(b) by 219 days.

(21) Appl. No.: 15/861,091

(22) Filed: Jan. 3, 2018

(65) Prior Publication Data

US 2019/0203439 A1 Jul. 4, 2019

(51) Int. Cl.
*E02D 7/10* (2006.01)
*E02D 7/14* (2006.01)

(52) U.S. Cl.
CPC . *E02D 7/10* (2013.01); *E02D 7/14* (2013.01)

(58) Field of Classification Search
CPC ..... E02D 7/10
USPC ..... 173/90, 184
See application file for complete search history.

(56) References Cited

U.S. PATENT DOCUMENTS 2,917,953 A * 12/1959 Badali ..... B25H 1/0035 254/93 HP
4,484,638 A * 11/1984 West ..... B21J 7/28 173/200
5,819,857 A * 10/1998 Rohrer ..... E04H 17/263 173/90
6,776,242 B1 * 8/2004 Cunningham ..... E04H 17/263 173/124
9,157,253 B2 * 10/2015 Rohrer, Jr. ..... E04H 17/26
2011/0155403 A1 * 6/2011 Rohrer ..... E02D 7/10 173/114
2014/0262399 A1 * 9/2014 Cunningham ..... E04H 17/263 173/133

* cited by examiner

*Primary Examiner* — Praachi M Pathak
(74) *Attorney, Agent, or Firm* — Mark Terry

(57) ABSTRACT

A piling hammer is disclosed. The piling hammer includes a sleeve for securely fitting around a top end of a piling, a hammer located on top of the sleeve, a first and second pneumatic cylinder secured to the sleeve and hammer, a first and second valve pneumatically coupled to the first and second pneumatic cylinders, and a pneumatic controller configured for detecting that the hammer is at a bottom position, activating the first and second valves to route pressurized gas from the pressurized gas source to the first and second pneumatic cylinders, thereby causing the hammer to rise upwards, detecting that the hammer is at a top position, activating the first and second valves to expel pressurized gas from the first and second pneumatic cylinders, thereby causing the hammer to strike the sleeve and drive the piling downwards.

18 Claims, 12 Drawing Sheets

PNEUMATIC PILING HAMMER FOR SUBMERSION PILINGS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNOLOGICAL FIELD

Most broadly, the disclosed subject matter relates to the field of pile drivers, and more particularly, it is directed to pile drivers for marine grade submersion pilings.

BACKGROUND

A pile driver or piling hammer is a mechanical device used to drive piles, pilings or poles into the Earth to provide foundation support for docks, buildings or other structures. A conventional pile driver or piling includes a heavy weight that it is able to freely slide up and down in a single line, wherein the weight is placed above a pile, piling or pole. The weight is raised, and when the weight reaches its highest point, it is released and impacts the pile, piling or pole in order to drive it into the ground.

Various devices have been developed for driving pilings into the Earth, but they have encountered a variety of problems. One known problem with conventional piling hammers or pile drivers is that they generally are not compact integral units. One type of conventional piling hammer comprises a hammer and a separate device that lifts and drops the hammer onto the piling, such as a crane or other lifting device. The use of multiple separate systems in said conventional piling hammers adds to the complexity of the system as a whole, and detracts from its usefulness and mean time to failure. Another known problem with conventional piling hammers is the mean time to failure of the components of the system. Since the act of pile driving inherently involves creating high energy impacts, this leads to quick and heavy wear and tear on the components of the system. This results in reduced mean time to failure and an increase in the costs of owning and maintaining said systems.

Another problem with conventional piling hammers involves the driving of submersion grade pilings. When driving submersion grade pilings for docks and other structures on or near a body of water, the piling hammer is surrounded by high amounts of fresh, brackish or salt water, which can be very corrosive to various components of the system, including metal, integrated circuits and copper coils. This also results in reduced mean time to failure and an increase in the costs of owning and maintaining said systems.

Consequently, a need exists to overcome the problems with the prior art as discussed above, and particularly for improved and innovative pilings hammers.

SUMMARY

Briefly, according to an embodiment, a piling hammer is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the piling hammer includes a sleeve comprising a hollow element having a closed top end and an open bottom end configured for securely fitting around a top end of a piling, the sleeve including a first and second flange extending outwards from each side of the sleeve, a guide rod extending upwards from the sleeve, a hammer located on top of the sleeve, the hammer having a weight of at least 300 pounds, the hammer including a first and second flange extending outwards from each side of the hammer, a guide tube extending downwards from the hammer and configured such that a top portion of the guide rod is located within the guide tube, a first pneumatic cylinder comprising a chamber on one end and a rod on another end, the chamber secured to the first flange of the sleeve and the rod secured to the first flange of the hammer, a second pneumatic cylinder comprising a chamber on one end and a rod on another end, the chamber of the second pneumatic cylinder secured to the second flange of the sleeve and the rod of the second pneumatic cylinder secured to the second flange of the hammer, a first valve pneumatically coupled to the chamber of the first pneumatic cylinder, wherein the first valve controls pressurized gas entering the chamber from a pressurized gas source and exiting the chamber, a second valve pneumatically coupled to the chamber of the second pneumatic cylinder, wherein the second valve controls pressurized gas entering the chamber from the pressurized gas source and exiting the chamber, at least one pneumatic contact sensor configured for sensing a position of the guide tube, a planar element comprised of a polymer, the planar element coupled to at least one bracket coupled to the sleeve, a pneumatic controller fastened to the planar element so as to isolate the pneumatic controller from vibrations of the sleeve and hammer, the pneumatic controller pneumatically coupled with the at least one pneumatic contact sensor, the first and second valves, and the pressurized gas source, the pneumatic controller configured for: a) detecting, via the contact sensor, that the hammer is at a bottom position; b) activating the first and second valves to route pressurized gas from the pressurized gas source to the chambers of the first and second pneumatic cylinders, thereby moving the rods of the first and second pneumatic cylinders upwards, and causing the hammer to rise upwards; c) detecting, via the contact sensor, that the hammer is at a top position; d) activating the first and second valves to expel pressurized gas from the chambers of the first and second pneumatic cylinders, thereby causing the rods of the first and second pneumatic cylinders to fall downwards, and the hammer to strike the sleeve and drive the piling downwards; and e) repeating steps a) through d).

The foregoing and other features and advantages of the disclosed embodiments will be apparent from the following more particular description of the preferred embodiments, as illustrated in the accompanying drawings.

BRIEF DESCRIPTION OF THE DRAWINGS

The claimed subject matter is particularly pointed out and distinctly claimed in the claims at the conclusion of the specification. The foregoing and other features and also the advantages of the disclosed embodiments will be apparent from the following detailed description taken in conjunction with the accompanying drawings.

Like reference numerals refer to like parts throughout the several views of the drawings.

DETAILED DESCRIPTION

Figure 1A:
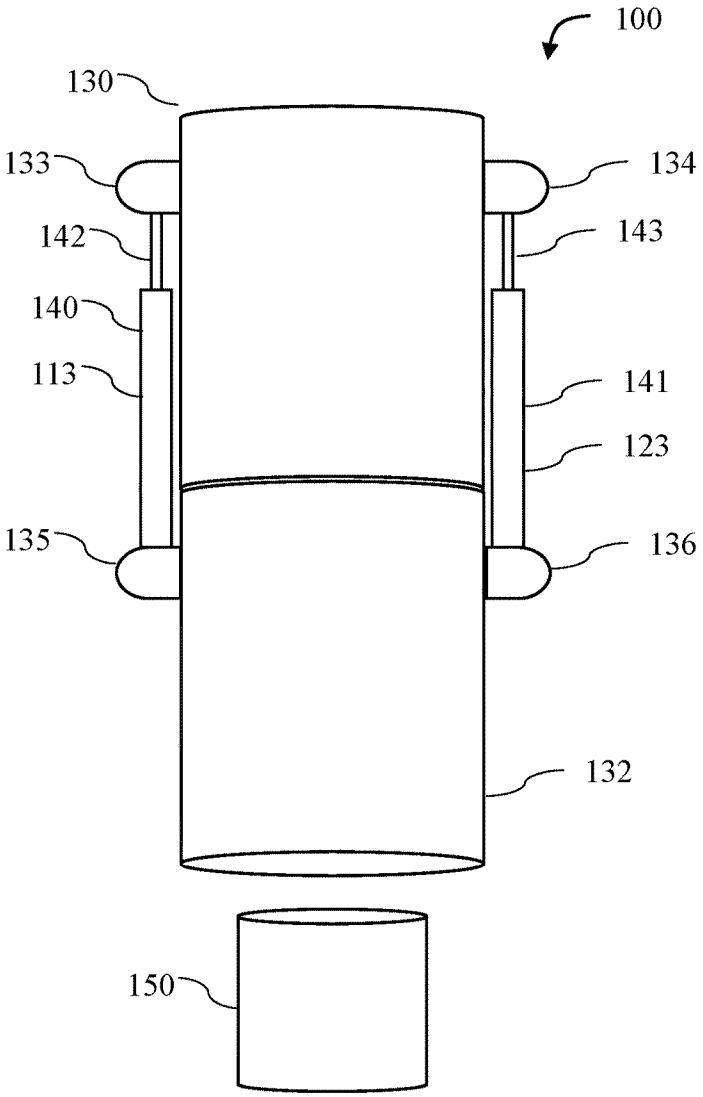
FIG. 1A is an illustration of a side view of the pneumatic piling hammer for submersion grade pilings, showing the hammer in a bottom position, according to one embodiment.

The following detailed description is merely exemplary in nature and is not intended to limit the described embodiments or the application and uses of the described embodiments. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the claimed subject matter as oriented in each figure. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The disclosed embodiments solve the problems with the prior art by providing an innovative and ingenious piling hammer device that reduces mean time to failure due to high energy impact forces, as well as hindering the advancement of corrosion due to being in a harsh water or ocean environment. The claimed subject matter further discloses a fully integrated system that does not depend on an external device for controlling the system, so as to increase the usefulness of the system and reduce its complexity.

The disclosed embodiments are fully pneumatic and do not include any electrical circuits or hydraulics. There are various advantages to using a fully pneumatic system, void of any electrical circuits or hydraulics, including simplicity of design and control. Pneumatic systems are easily designed using standard cylinders and other components, and operate via simple on-off control. With regard to reliability, pneumatic systems generally have long operating lives and require little maintenance. Because gas is compressible, pneumatic equipment is less subject to shock damage. Further, gas absorbs excessive force, whereas fluid in hydraulics directly transfers force. Also, compressed gas can be stored, so pneumatic machines still run for a period of time if electrical power is lost or a gas engine depletes gas fuel. With regard to safety, there is a very low chance of fire compared to hydraulic oil, and pneumatic machines are usually overload safe.

The disclosed embodiments further provide a system that is compact, and easy to handle, hoist onto a piling and operate. Due to the lack of gas engines, oils and other chemicals, the disclosed embodiments are further environmentally safe and occupationally safe for workers. Additionally, due to the multiple vibration and impact isolation features in place, the disclosed embodiments reduce wear and tear on the system, resulting in a decrease in the mean time to failure of the components of the system, as well as a decrease in maintenance frequency and maintenance costs.

FIG. 1A is an illustration of a side view of the pneumatic piling hammer 100 for submersion grade pilings, showing the hammer 130 in a bottom position, according to one embodiment. A submersion grade piling is a piling that may be composed of wood, metal, plastic, cement, or any combination of the above, and which has been constructed and/or treated for installation into ground that is submerged underwater, such as a seabed, or a riverbed. Submersion grade pilings are constructed to withstand water and ocean environments. The pneumatic piling hammer 100 includes a sleeve 132 comprising a hollow element having a closed top end and an open bottom end configured for securely fitting around a top end of a piling 150, the sleeve including a first flange 135 and second flange 136 extending outwards from each side of the sleeve. The sleeve 132 may be cylindrical shaped or cuboid shaped. A hammer 130 is located on top of the sleeve 132, the hammer having a weight of at least 150 pounds, at least 300 pounds, at least 450 pounds, or at least 600 pounds. The hammer also including a first flange 133 and second flange 134 extending outwards from each side of the hammer. The hammer 130 may be cylindrical shaped or cuboid shaped, as well as other shapes.

The pneumatic piling hammer 100 includes a first pneumatic cylinder 113 comprising a chamber 140 on one end and a rod 142 on another end, the chamber secured to the first flange 135 of the sleeve and the rod secured to the first flange 133 of the hammer. The pneumatic piling hammer 100 also includes a second pneumatic cylinder 123 comprising a chamber 141 on one end and a rod 143 on another end, the chamber of the second pneumatic cylinder secured to the second flange 136 of the sleeve and the rod of the second pneumatic cylinder secured to the second flange 134 of the hammer.

A pneumatic cylinder (or air cylinder) is a mechanical device which use the power of compressed gas to produce a force in a reciprocating linear motion. Like hydraulic cylinders, a pneumatic cylinder forces a piston to move in the desired direction. The piston is a disc or cylinder, and the piston rod transfers the force it develops to the object to be moved.

Figure 1B:
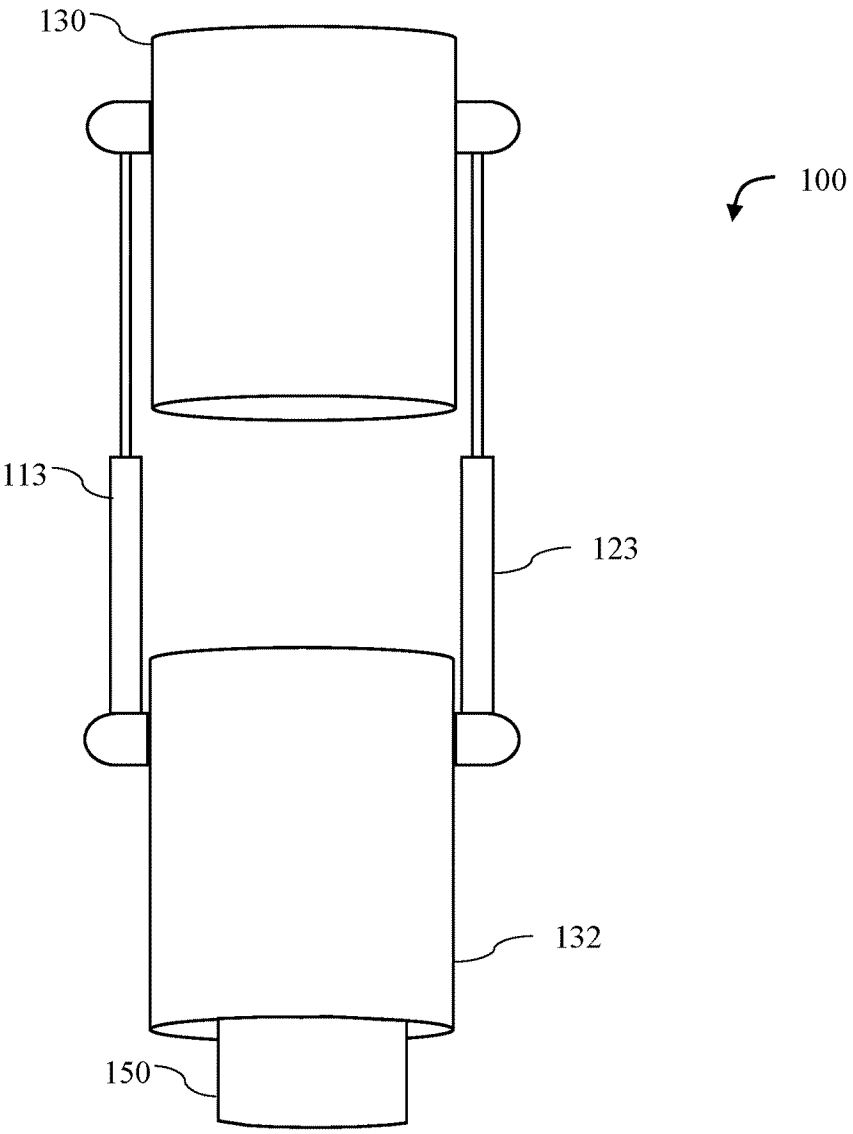
FIG. 1B is an illustration of a side view of the pneumatic piling hammer for submersion grade pilings, showing the hammer in a top position, according to one embodiment.

FIG. 1B is an illustration of a side view of the pneumatic piling hammer 100 for submersion grade pilings, showing the hammer 130 in a top position, according to one embodiment. FIG. 1B shows that the sleeve 132 has been placed on top of and over the piling 150. FIG. 1B also shows that the chambers of the first and second pneumatic cylinders 113, 123 have been pressurized, resulting in the rods of the first and second pneumatic cylinders extending upwards, and the hammer 130 rising up to a top position. This imbues the hammer with potential energy that is translated to the piling 150 when the hammer is dropped onto the piling, thereby driving the piling to the Earth.

Figure 1C:
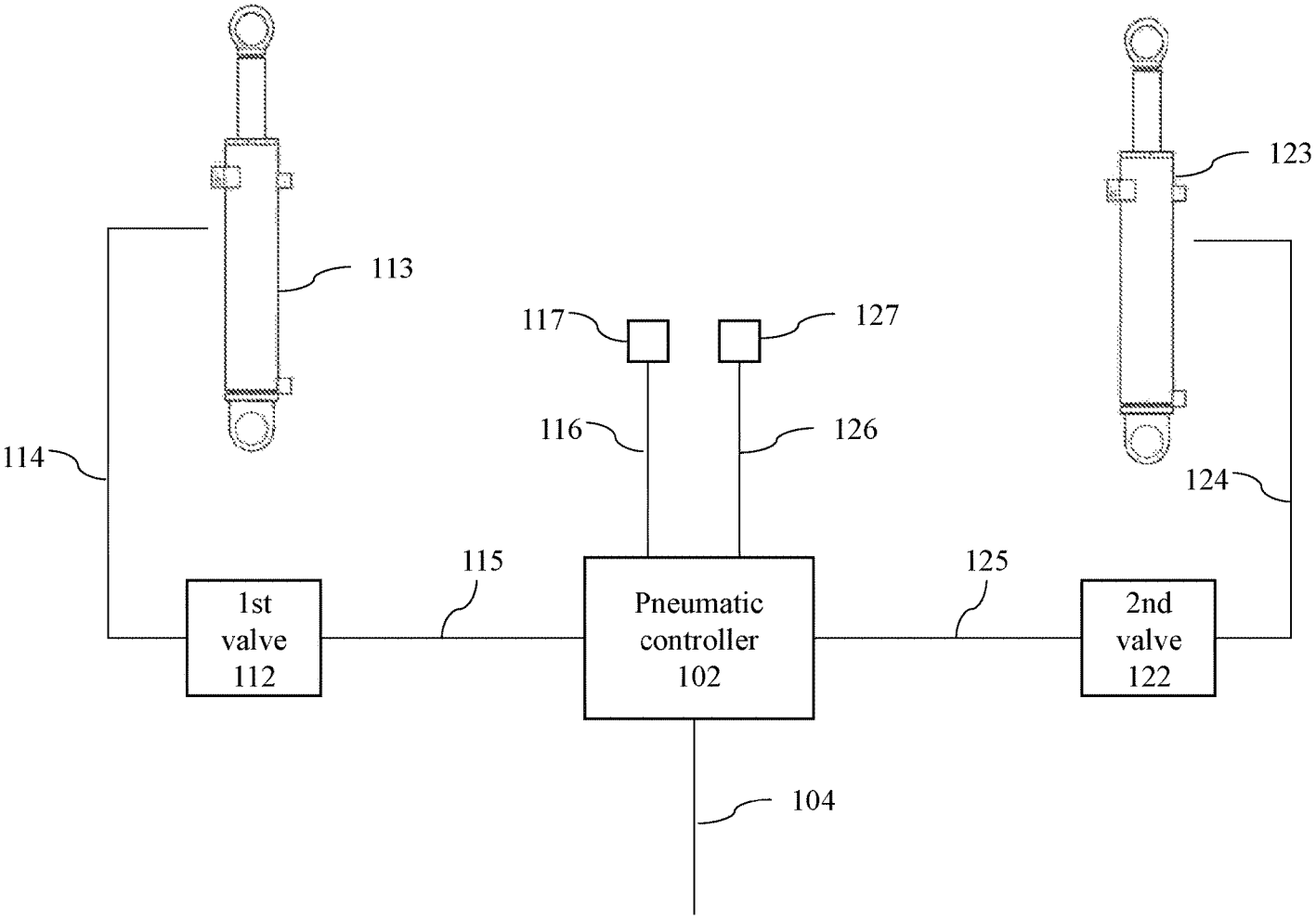
FIG. 1C is an illustration of various components of the pneumatic piling hammer for submersion grade pilings, according to one embodiment.

FIG. 1C is an illustration of various components of the pneumatic piling hammer 100 for submersion grade pilings, according to one embodiment. FIG. 1C shows the first pneumatic cylinder 113 and the second pneumatic cylinder 123. FIG. 1C also shows the first valve 112 pneumatically coupled to the chamber 140 of the first pneumatic cylinder 113 via a pressurized gas line 114 (which may be flexible), wherein the first valve controls pressurized gas entering the chamber (from a pressurized gas source) and exiting the chamber. The first valve 112 is pneumatically coupled to a pneumatic controller 102 via a pressurized gas line 115 (which may be flexible), and which may also serve as the pressurized gas source for the chamber 140 of the first pneumatic cylinder 113. Flexible gas lines dampen pulses and other forces travelling through the gas lines. The flexible nature of lines 114 and 155 serve to isolate the first valve from vibrations and impacts of the sleeve and hammer, which reduces wear and tear, as well as maintenance and related costs.

FIG. 1C also shows the second valve 122 pneumatically coupled to the chamber 141 of the second pneumatic cylinder 123 via a pressurized gas line 124 (which may be flexible), wherein the second valve controls pressurized gas entering the chamber (from the pressurized gas source) and exiting the chamber. The second valve 122 is pneumatically coupled to the pneumatic controller 102 via a pressurized gas line 125 (which may be flexible), and which may also serve as the pressurized gas source for the chamber 141 of the second pneumatic cylinder 123. The flexible nature of lines 124 and 125 serve to isolate the second valve from vibrations and impacts of the sleeve and hammer.

The pneumatic controller 102 activates the first and second valves 112, 122 to route pressurized gas from the pressurized gas source to the chambers of the first and second pneumatic cylinders 113, 123 by sending a first predefined pressure pulse via the pressurized gas lines 115, 125. The pneumatic controller 102 also activates the first and second valves to expel pressurized gas from the chambers of the first and second pneumatic cylinders by sending a second predefined pressure pulse via the pressurized gas lines 115, 125.

FIG. 1C also shows two pneumatic contact sensors 117, 127 configured for sensing a position of a guide tube (discussed below). A pneumatic contact sensor is a contact sensor that senses the proximity of an object and uses pneumatic circuitry to transmit information. The contact functionality of the pneumatic contact sensor may be a pneumatic touch sensor or a pneumatic proximity sensor, which are well known in the art. The first pneumatic contact sensor 117 detects when the hammer is at a bottom position, and the second pneumatic contact sensor 127 detects when the hammer is at a top position. The first pneumatic contact sensor 117 may be pneumatically coupled to the pneumatic controller 102 via a pressurized gas line 116 (which may be flexible), and the second pneumatic contact sensor 127 may be pneumatically coupled to the pneumatic controller 102 via a pressurized gas line 126 (which may be flexible). The flexible nature of lines 116 and 126 serve to isolate the two pneumatic contact sensors 117, 127 from vibrations and impacts of the sleeve and hammer, which reduces wear and tear, as well as maintenance and related costs.

The pneumatic controller 102 detects that the hammer 130 is at a bottom position by detecting a third predefined pressure pulse sent by the first pneumatic contact sensor 117 via the pressurized gas line 116. The pneumatic controller 102 detects that the hammer is at a top position by detecting a fourth predefined pressure pulse sent by the second pneumatic contact sensor 127 via the pressurized gas line 126. The pneumatic controller 102 may be connected to a pressurized gas source (such as an air compressor) via a pressurized gas line 104, which may be flexible.

The pneumatic controller 102 is a pneumatic circuit, which is an interconnected set of components that convert compressed gas into mechanical work. The pneumatic controller 102 is configured for: detecting, via the contact sensors 117, 127, that the hammer is at a bottom position; activating the first and second valves 112, 122 to route pressurized gas from the pressurized gas source to the chambers of the first and second pneumatic cylinders 113, 123, thereby moving the rods of the first and second pneumatic cylinders upwards, and causing the hammer 130 to rise upwards; detecting, via the contact sensors, that the hammer is at a top position; activating the first and second valves to expel pressurized gas from the chambers of the first and second pneumatic cylinders, thereby causing the rods of the first and second pneumatic cylinders to fall downwards, and the hammer to strike the sleeve and drive the piling downwards; and repeating the above steps over again.

Figure 2:
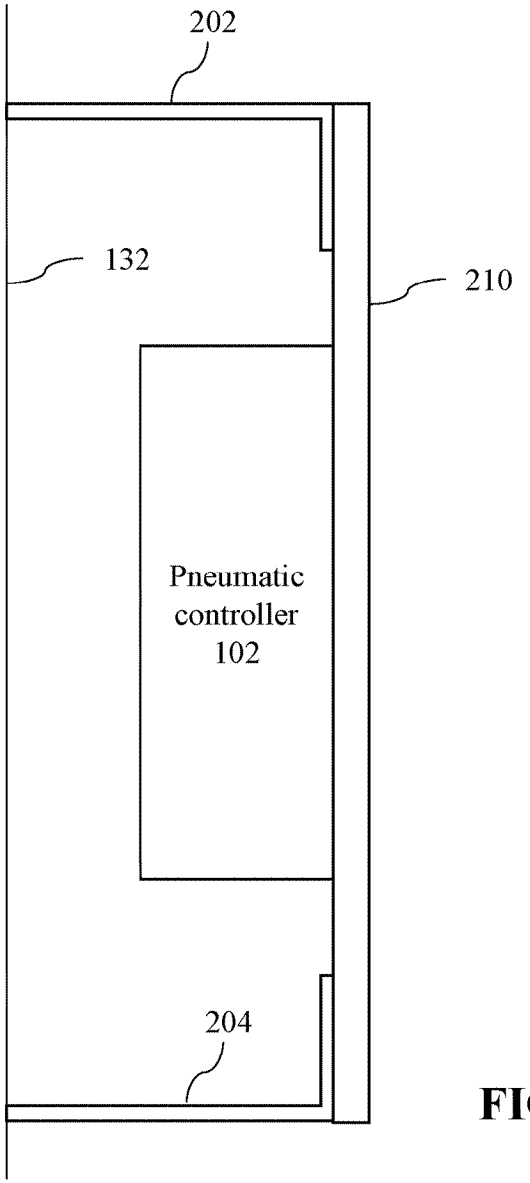
FIG. 2 is an illustration of the placement of the pneumatic controller of the pneumatic piling hammer for submersion grade pilings, according to one embodiment.

FIG. 2 is an illustration of the placement of the pneumatic controller 102 of the pneumatic piling hammer 100 for submersion grade pilings, according to one embodiment. FIG. shows a side view of the system 100, which provides detail of the placement of pneumatic controller 102 on the sleeve 132. FIG. 2 shows that the controller 102 is fastened to a planar element 210, which may be polymer based element, such as a PVC interwoven fabric, a thermoplastic fabric, a rubber compounds fabric, a polyurethane fabric, or any combination of the above. The controller 102 may be fastened to the planar element 210 using fasteners, such as nuts and bolts, or using an adhesive. The ends of the planar element 210 are coupled to L-brackets 202, 204, which are coupled or connected to the sleeve 132. The L-brackets may be metallic and may be welded to the sleeve. Since the pneumatic controller 102 is only coupled to the flexible planar element 210 (which dampens pulses and other forces travelling through the planar element), the pneumatic controller is isolated from vibrations and impacts of the sleeve and hammer, which reduces wear and tear, as well as maintenance and related costs. Further, since the lines 115, 116, 126, 125, 104 are flexible, this further serves to isolate the pneumatic controller from vibrations and impacts.

Figure 3:
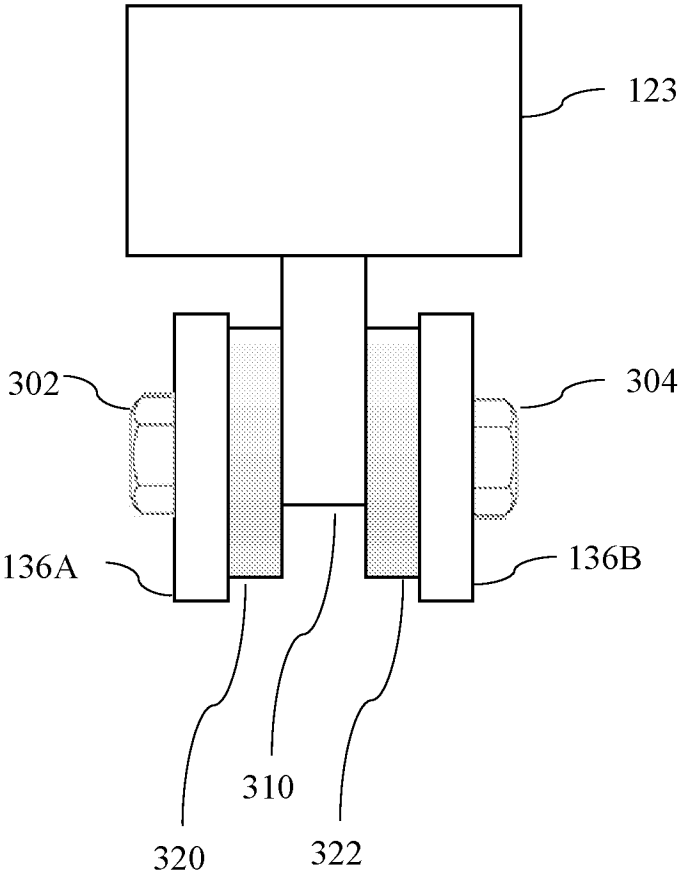
FIG. 3 is an illustration of the junction of the pneumatic cylinder of the pneumatic piling hammer for submersion grade pilings with a flange, according to one embodiment.

FIG. 3 is an illustration of the junction of the pneumatic cylinder 123 of the pneumatic piling hammer for submersion grade pilings with a flange 136, according to one embodiment. The chamber 141 of the pneumatic cylinder 123 is secured to the first flange 136 of the sleeve 132 via two polymer setoffs 320, 322. FIG. 3 shows that the bottom portion of pneumatic cylinder 123 includes a flange 310 that extends downwards from the bottom portion of the cylinder 123 and that may include an orifice (not shown). The flange 136 of FIG. 1 may comprise two sub flanges 136A and 136B, both of which extend outwards from the sleeve 132 and may include an orifice. The flange 310 is aligned with the two sub flanges 136A and 136B such that the orifices of all three flanges are aligned. Then, two setoffs 320, 322, or toroidal shaped pieces of polymer material, are placed on either side of the flange 310, to act as dampening buffers between the flange 310 and the two sub flanges 136A and 136B. Then, the two setoffs 320, 322 are aligned with flange 310, and two sub flanges 136A and 136B, such that the orifices of all three flanges are aligned with the orifices in the two setoffs 320, 322. Subsequently, a threaded bolt (not shown), may extend through the orifices of flange 310, two sub flanges 136A and 136B and the two setoffs 320, 322. Finally, a bolt 302 and 304 may be affixed to either side of the bolt, so as to fasten flange 310, two sub flanges 136A and 136B and the two setoffs 320, 322 together. The two setoffs 320, 322 dampen pulses and other forces travelling through the setoffs, and therefore the pneumatic cylinder 123 is isolated from vibrations and impacts of the sleeve and hammer, which reduces wear and tear, as well as maintenance and related costs. The same connection or coupling system shown in FIG. 3 may be used for the connection between cylinder 123 and flange 134, between cylinder 113 and flange 133, and between cylinder 113 and flange 135.

Figure 4:
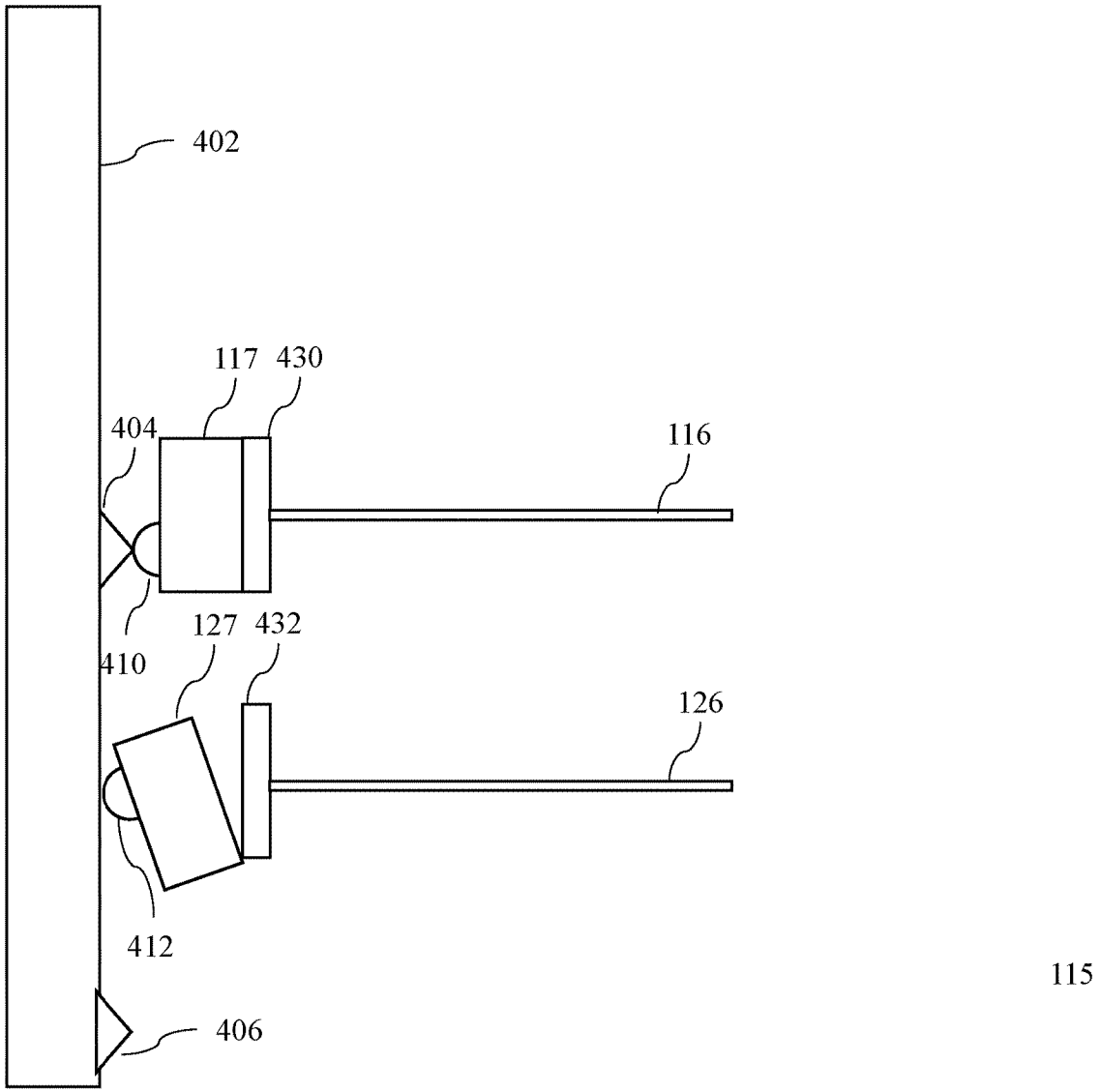
FIG. 4 is an illustration of the sensors of the pneumatic piling hammer for submersion grade pilings, according to one embodiment.

FIG. 4 is an illustration of the sensors 117, 127 of the pneumatic piling hammer for submersion grade pilings, according to one embodiment. FIG. 4 show that sensor 127 includes a roller or wheel 412 that rolls against the guide tube 402 as the guide tube moves up and down during operation of the piling hammer 100.

In FIG. 4, the hammer 130 is at the bottom position. Located on the guide tube are two bumps or protrusions 404, 406, which are aligned on the guide tube such that when the hammer is at the bottom position, the protrusion 404 contacts the roller 410 of sensor 117, and when the hammer is at the top position, the protrusion 406 contacts the roller 412 of sensor 127. When a roller contacts a protrusion, this activates the sensor, which results in the sensor sending a pressure pulse via the pressurized gas line. When the roller 410 contacts the protrusion 404, this activates sensor 117, which results in the sensor 117 sending a pressure pulse via the pressurized gas line 116. When the roller 412 contacts the protrusion 406, this activates sensor 127, which results in the sensor 127 sending a pressure pulse via the pressurized gas line 126.

In one embodiment, the system 100 includes a second planar element comprised of a polymer, the second planar element coupled to at least one bracket (such as an L-bracket) coupled to the sleeve 132, and wherein the pneumatic contact sensors 117, 127 are fastened to the second planar element so as to isolate the pneumatic contact sensors from vibrations and impacts of the sleeve and hammer, which reduces wear and tear, as well as maintenance and related costs.

Figure 6:
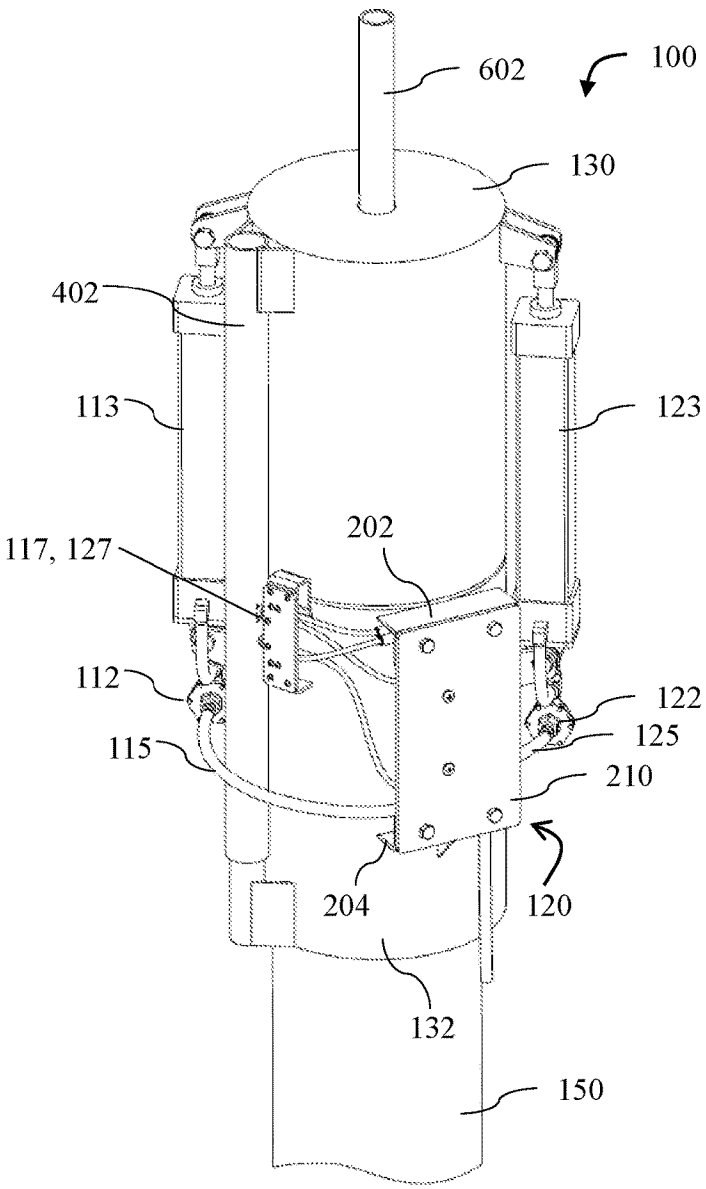
FIG. 6 is an illustration of a perspective frontal view of the pneumatic piling hammer for submersion grade pilings, shown in a bottom position, according to one embodiment.

FIG. 6 is an illustration of a perspective frontal view of the pneumatic piling hammer 100 for submersion grade pilings, shown in a bottom position, according to one embodiment. FIG. 6 shows the hammer 130 resting on top of the sleeve 132 (which rests on top of the piling 150), as well as pneumatic cylinders 113, and 123. FIG. 6 further shows the first valve 112 pneumatically coupled to a pneumatic controller 102 via a pressurized gas line 115 (which may be flexible), and which may also serve as the pressurized gas source for the chamber 140 of the first pneumatic cylinder 113. FIG. 6 further shows the second valve 122 pneumatically coupled to the pneumatic controller 102 via a pressurized gas line 125 (which may be flexible), and which may also serve as the pressurized gas source for the chamber 141 of the second pneumatic cylinder 123. FIG. 6 further shows the pneumatic sensors 117, 127 pneumatically coupled to the controller 102 and in contact with the guide tube 402. Lastly, FIG. 6 shows a central guide tube 602, described in greater detail below.

FIG. 6 also shows the controller 102 may be fastened to a planar element 210 using fasteners, such as nuts and bolts, or using an adhesive. The ends of the planar element 210 are coupled to L-brackets 202, 204, which are coupled or connected to the sleeve 132. The L-brackets may be metallic and may be welded to the sleeve.

Figure 7:
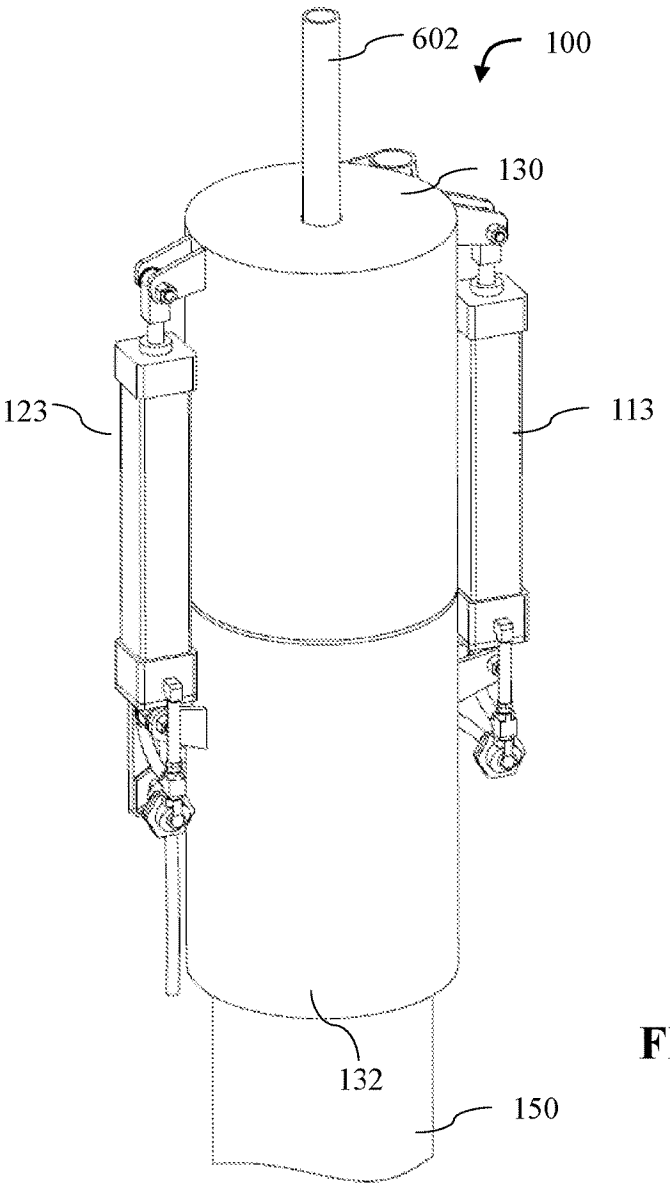
FIG. 7 is an illustration of a perspective rear view of the pneumatic piling hammer for submersion grade pilings, shown in a bottom position, according to one embodiment.

FIG. 7 is an illustration of a perspective rear view of the pneumatic piling hammer 100 for submersion grade pilings, shown in a bottom position, according to one embodiment. FIG. 7 shows the hammer 130 resting on top of the sleeve 132 (which rests on top of the piling 150), as well as pneumatic cylinders 113, and 123. Lastly, FIG. 7 shows a central guide tube 602, described in greater detail below. In one embodiment, the top end of guide tube 602 may include an orifice extends horizontally through the top end of the tube, through which a high strength pin is extended. Subsequently, a wire loop or picking cable may extend around the pin. The wire loop or picking cable may be attached to a hook or clevis coupled to a crane, which can then hoist the device up and onto a piling, or hoist the device up and off of a piling after use.

Figure 8:
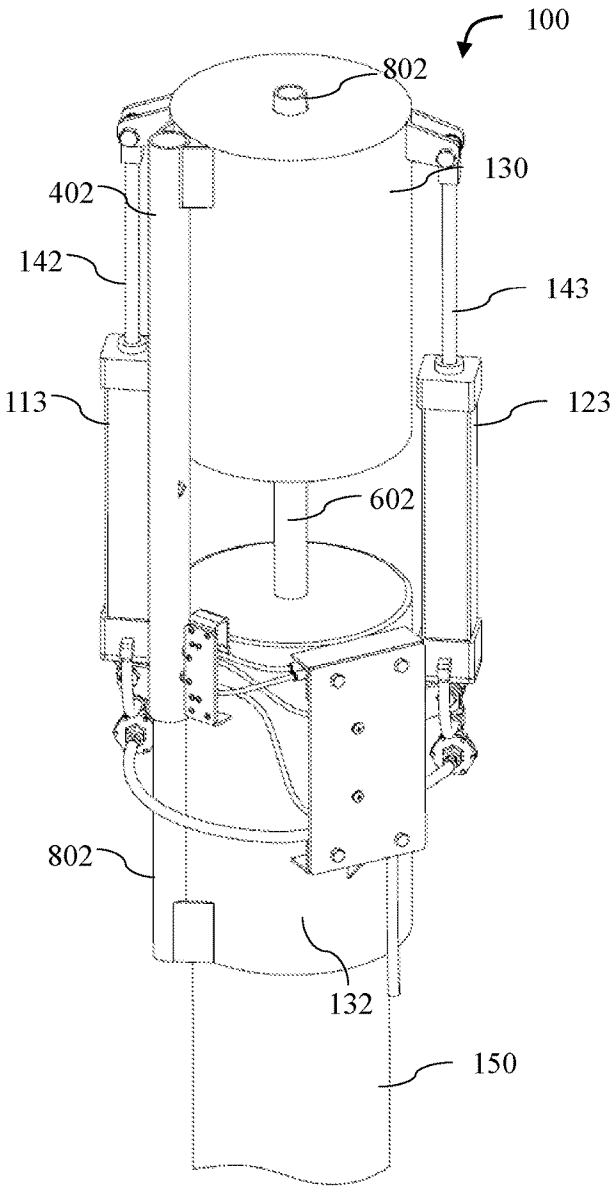
FIG. 8 is an illustration of a perspective frontal view of the pneumatic piling hammer for submersion grade pilings, shown in a top position, according to one embodiment.

FIG. 8 is an illustration of a perspective frontal view of the pneumatic piling hammer 100 for submersion grade pilings, shown in a top position, according to one embodiment. FIG. 8 shows the hammer 130 has been raised to full extension above the sleeve 132 (which rests on top of the piling 150). FIG. 8 also shows that the rods 142, 143 of the pneumatic cylinders 113, 123 have been fully extended so as to raise the hammer 130 to its top position. Lastly, FIG. 8 shows a central guide tube 602, which originates at, and is coupled to, the top surface of the sleeve 132 and extends upwards towards the hammer 130. The central guide tube 602 extends through an orifice 802 in the hammer 130. The combination of the central guide tube 602 and orifice 802 provides a system wherein the hammer 130 is guided as it moves up and down, and prevents the hammer from moving laterally or away from the central axis defined by the central guide tube. This system reduces the wear and tear on the system and therefore reduces the mean time to failure of the components of the system, as well frequency of maintenance, and maintenance costs.

FIG. 8 further shows that a guide rod 802 originates at, and is coupled to, the side surface of the sleeve 132 and extends upwards towards the hammer 130. The guide rod 802 extends though guide tube 402, which is coupled to the side of the hammer 130. The combination of the guide rod 802 and guide tube 402 provides a system wherein the hammer 130 is guided as it moves up and down, and prevents the hammer from moving laterally or away from the central axis defined by the central guide tube, and prevents the hammer from rotating about the central axis.

This system reduces the wear and tear on the system and therefore reduces the mean time to failure of the components of the system, as well frequency of maintenance, and maintenance costs.

Figure 9:
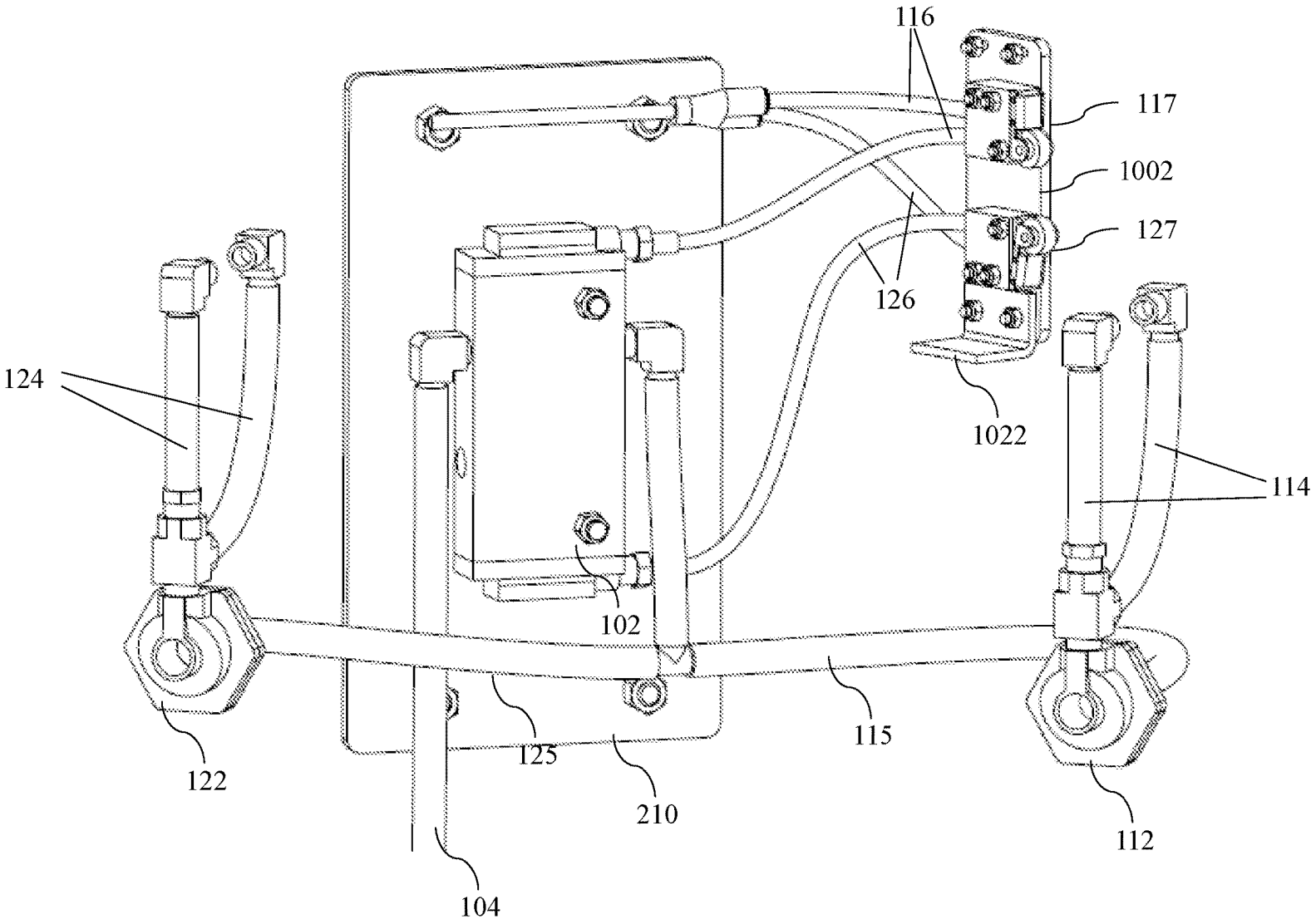
FIG. 9 is an illustration of several pneumatic components of the pneumatic piling hammer for submersion grade pilings, according to one embodiment.

FIG. 9 is an illustration of several pneumatic components of the pneumatic piling hammer 100 for submersion grade pilings, according to one embodiment. FIG. 9 shows the first valve 112 for coupling to the first pneumatic cylinder 113 via a pressurized gas line or lines 114 (which may be flexible). The first valve 112 is pneumatically coupled to the pneumatic controller 102 via a pressurized gas line 115 (which may be flexible). FIG. 9 also shows the second valve 122 for coupling to the second pneumatic cylinder 123 via a pressurized gas line or lines 124 (which may be flexible). The second valve 122 is pneumatically coupled to the pneumatic controller 102 via a pressurized gas line 125 (which may be flexible). Lines 115 and 125 may be the same line or may share a continuous inner volume.

FIG. 9 also shows two pneumatic contact sensors 117, 127 configured for sensing a position of a guide tube. The first pneumatic contact sensor 117 detects when the hammer is at a bottom position, and the second pneumatic contact sensor 127 detects when the hammer is at a top position. The first pneumatic contact sensor 117 may be pneumatically coupled to the pneumatic controller 102 via a pressurized gas line or lines 116 (which may be flexible), and the second pneumatic contact sensor 127 may be pneumatically coupled to the pneumatic controller 102 via a pressurized gas line or lines 126 (which may be flexible). FIG. 9 shows that the controller 102 is fastened to a planar element 210, which may be a polymer based element, such as plastic, rubber, etc.

Figure 10:
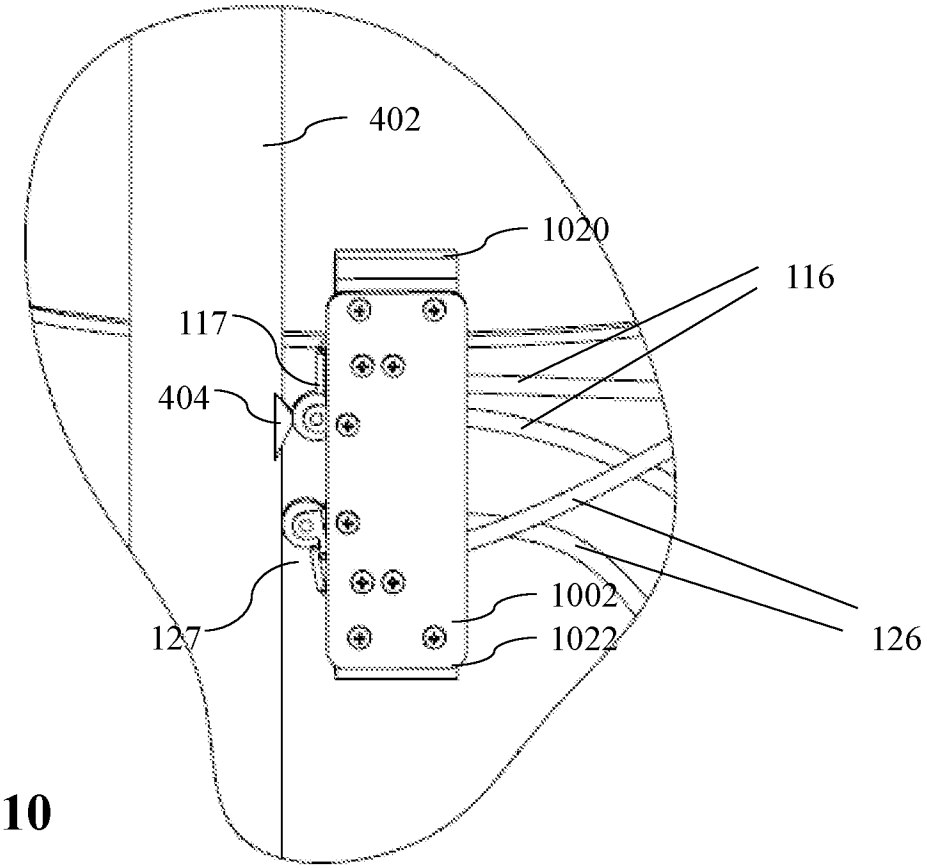
FIG. 10 is an illustration of a close-up of the pneumatic sensor components of the pneumatic piling hammer for submersion grade pilings, according to one embodiment.

FIG. 10 is an illustration of a close-up of the pneumatic sensor components of the pneumatic piling hammer 100 for submersion grade pilings, according to one embodiment. FIG. 10 shows two pneumatic contact sensors 117, 127 configured for sensing a position of a guide tube 402. The first pneumatic contact sensor 117 detects when the hammer is at a bottom position, and the second pneumatic contact sensor 127 detects when the hammer is at a top position. The first pneumatic contact sensor 117 may be pneumatically coupled to the pneumatic controller 102 via a pressurized gas line or lines 116, and the second pneumatic contact sensor 127 may be pneumatically coupled to the pneumatic controller 102 via a pressurized gas line or lines 126. FIG. 9 shows that the pneumatic contact sensors are fastened to a planar element 1002, which may be a polymer based element, such as plastic, rubber, etc. The ends of the planar element 1002 are coupled to L-brackets 1020, 1022, which are coupled or connected to the sleeve 132. The L-brackets may be metallic and may be welded to the sleeve. Located on the guide tube 402 are two bumps or protrusions 404, 406, which are aligned on the guide tube such that when the hammer is at the bottom position, the protrusion 404 contacts the roller 410 of sensor 117.

Figure 5:
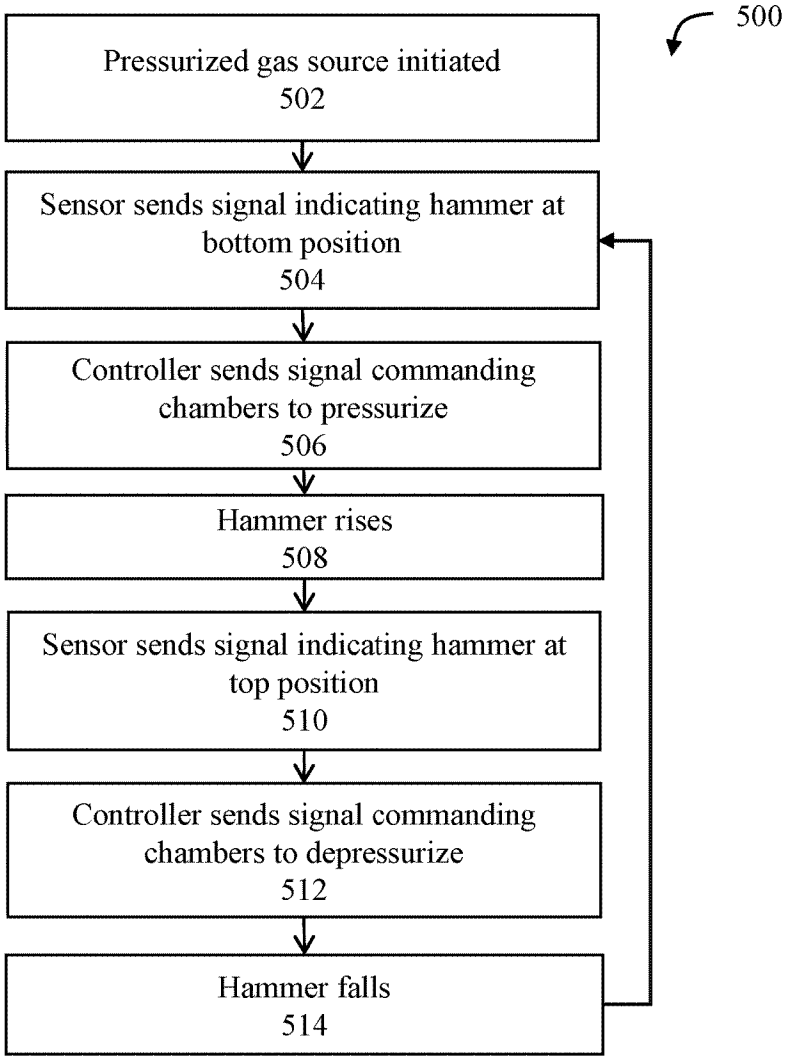
FIG. 5 is a flowchart showing the control flow of the process undertaken by the pneumatic piling hammer for submersion grade pilings, according to one embodiment.

FIG. 5 is a flowchart showing the control flow of the process undertaken by the pneumatic piling hammer 100 for submersion grade pilings, according to one embodiment. FIG. 5 describes the steps that are undertaken by the pneumatic piling hammer 100 when the device is initiated for driving a submersion grade piling into the Earth. In a first step 502, the pressurized gas source, such as an air compressor, is initiated, which activates the pneumatic controller 102. The pneumatic controller 102, in step 504, detects via the contact sensors 117, 127 that the hammer 130 is at a bottom position. The pneumatic controller 102 accomplishes this step by detecting a third predefined pressure pulse sent by the first pneumatic contact sensor 117 via the pressurized gas line 116.

In step 506, the pneumatic controller 102 activates the first and second valves 112, 122 to route pressurized gas from the pressurized gas source to the chambers of the first and second pneumatic cylinders 113, 123, thereby moving the rods of the first and second pneumatic cylinders upwards, and causing the hammer 130 to rise upwards in step 508. The pneumatic controller 102 accomplishes this step by sending a first predefined pressure pulse via the pressurized gas lines 115, 125 to the first and second valves 112, 122.

In step 510, the pneumatic controller 102 detects via the contact sensors 117, 127 that the hammer 130 is at a top position. The pneumatic controller 102 accomplishes this step by detecting a fourth predefined pressure pulse sent by the second pneumatic contact sensor 127 via the pressurized gas line 126.

In step 512, the pneumatic controller 102 activates the first and second valves to expel pressurized gas from the chambers of the first and second pneumatic cylinders, thereby causing the rods of the first and second pneumatic cylinders to fall downwards, and the hammer to strike the sleeve and drive the piling downwards in step 514. The pneumatic controller 102 accomplishes this step by sending a second predefined pressure pulse via the pressurized gas lines 115, 125 to the first and second valves 112, 122. Subsequently, steps 504-514 are repeated over and over again, until the required depth is reached for the submersion grade piling and the system is turned off.

In one embodiment, the hammer 130 and sleeve 132, as well as the other components of the system 100, are composed of a corrosion resistant or corrosion proof material, including metals such as aluminum, lead, brass, bronze, copper alloy or the like.

Although specific embodiments have been disclosed, those having ordinary skill in the art will understand that changes can be made to the specific embodiments without departing from the spirit and scope of the claimed subject matter. The scope of the claimed subject matter is not to be restricted, therefore, to the specific embodiments. Furthermore, it is intended that the appended claims cover any and all such applications, modifications, and embodiments within the scope of the claimed subject matter.

I claim:

1. A piling hammer, comprising:

a sleeve comprising a hollow element having a closed top end and an open bottom end configured for securely fitting around a top end of a piling, the sleeve including a first and second flange extending outwards from each side of the sleeve;

a guide rod extending upwards from the sleeve;

a hammer located on top of the sleeve, the hammer having a weight of at least 300 pounds, the hammer including a first and second flange extending outwards from each side of the hammer;

a guide tube extending downwards from the hammer and configured such that a top portion of the guide rod is located within the guide tube;

a first pneumatic cylinder comprising a chamber on one end and a rod on another end, the chamber secured to the first flange of the sleeve and the rod secured to the first flange of the hammer;

a second pneumatic cylinder comprising a chamber on one end and a rod on another end, the chamber of the second pneumatic cylinder secured to the second flange of the sleeve and the rod of the second pneumatic cylinder secured to the second flange of the hammer;

a first valve pneumatically coupled to the chamber of the first pneumatic cylinder, wherein the first valve controls pressurized gas entering the chamber from a pressurized gas source and exiting the chamber;

a second valve pneumatically coupled to the chamber of the second pneumatic cylinder, wherein the second valve controls pressurized gas entering the chamber from the pressurized gas source and exiting the chamber;

at least one pneumatic contact sensor configured for sensing a position of the guide tube;

a first planar element comprised of a polymer, the first planar element coupled to at least one bracket coupled to the sleeve;

a pneumatic controller fastened to the first planar element so as to isolate the pneumatic controller from vibrations of the sleeve and hammer, the pneumatic controller pneumatically coupled with the at least one pneumatic contact sensor, the first and second valves, and the pressurized gas source, the pneumatic controller configured for:

a) detecting, via the at least one pneumatic contact sensor, that the hammer is at a bottom position by detecting a position of the guide tube;

b) activating the first and second valves to route pressurized gas from the pressurized gas source to the chambers of the first and second pneumatic cylinders, thereby moving the rods of the first and second pneumatic cylinders upwards, and causing the hammer to rise upwards;

c) detecting, via the at least one pneumatic contact sensor, that the hammer is at a top position by detecting a position of the guide tube;

d) activating the first and second valves to expel pressurized gas from the chambers of the first and second pneumatic cylinders, thereby causing the rods of the first and second pneumatic cylinders to fall downwards, and the hammer to strike the sleeve and drive the piling downwards; and e) repeating steps a) through d).

2. The piling hammer of claim 1, wherein the sleeve has a cylindrical shape.

3. The piling hammer of claim 2, wherein the hammer has a cylindrical shape.

4. The piling hammer of claim 3, wherein the first valve is pneumatically coupled to the pneumatic controller via a first pressurized gas line, and wherein the second valve is pneumatically coupled to the pneumatic controller via a second pressurized gas line.

5. The piling hammer of claim 4, wherein the pneumatic controller activates the first and second valves to route pressurized gas from the pressurized gas source to the chambers of the first and second pneumatic cylinders by sending a first predefined pressure pulse via the first and second pressurized gas lines.

6. The piling hammer of claim 5, wherein the pneumatic controller activates the first and second valves to expel pressurized gas from the chambers of the first and second pneumatic cylinders by sending a second predefined pressure pulse via the first and second pressurized gas lines.

7. The piling hammer of claim 6, wherein the at least one pneumatic contact sensor comprises a first pneumatic contact sensor that detects when the hammer is at the bottom position by detecting a position of the guide tube and a second pneumatic contact sensor that detects when the hammer is at the top position by detecting a position of the guide tube.

8. The piling hammer of claim 7, wherein the first pneumatic contact sensor is pneumatically coupled to the pneumatic controller via a third pressurized gas line, and wherein the second pneumatic contact sensor is pneumatically coupled to the pneumatic controller via a fourth pressurized gas line.

9. The piling hammer of claim 8, wherein the pneumatic controller detects that the hammer is at the bottom position by detecting a third predefined pressure pulse sent by the first pneumatic contact sensor via the third pressurized gas line.

10. The piling hammer of claim 9, wherein the pneumatic controller detects that the hammer is at the top position by detecting a fourth predefined pressure pulse sent by the second pneumatic contact sensor via the fourth pressurized gas line.

11. The piling hammer of claim 1, wherein the sleeve, the first and second flanges of the sleeve, the hammer, the first and second flanges of the hammer, the guide rod and the guide tube comprise a corrosion resistant metal.

12. The piling hammer of claim 11, wherein the chamber of the first pneumatic cylinder is secured to the first flange of the sleeve via a polymer, and the rod of the first pneumatic cylinder is secured to the first flange of the hammer via a polymer.

13. The piling hammer of claim 12, wherein the chamber of the second pneumatic cylinder is secured to the second flange of the sleeve via a polymer, and the rod of the second pneumatic cylinder is secured to the second flange of the hammer via a polymer.

14. The piling hammer of claim 13, further comprising a second planar element comprised of a polymer, the second planar element coupled to at least one bracket coupled to the sleeve, and wherein the at least one pneumatic contact sensor is fastened to the second planar element so as to isolate the at least one pneumatic contact sensor from vibrations of the sleeve.

15. The piling hammer of claim 14, wherein the first valve is pneumatically coupled to the chamber of the first pneumatic cylinder via a fifth pressurized gas line that is flexible, and wherein the first pressurized gas line is flexible, so as to isolate the first valve from vibrations of the sleeve and hammer.

16. The piling hammer of claim 15, wherein the second valve is pneumatically coupled to the chamber of the second pneumatic cylinder via a sixth pressurized gas line that is flexible, and wherein the second pressurized gas line is flexible, so as to isolate the second valve from vibrations of the sleeve and hammer.

17. A piling hammer, comprising:

a hollow cylindrical sleeve having a closed top end and an open bottom end configured for securely fitting around a top end of a piling, the sleeve including a first and second flange extending outwards from each side of the sleeve;

a guide rod extending upwards from the sleeve;

a solid cylindrical hammer located on top of the sleeve, the hammer having a weight of at least 300 pounds, the hammer including a first and second flange extending outwards from each side of the hammer;

a guide tube extending downwards from the hammer and configured such that a top portion of the guide rod is located within the guide tube;

a first pneumatic cylinder comprising a chamber on one end and a rod on another end, the chamber secured to the first flange of the sleeve and the rod secured to the first flange of the hammer;

a second pneumatic cylinder comprising a chamber on one end and a rod on another end, the chamber of the second pneumatic cylinder secured to the second flange of the sleeve and the rod of the second pneumatic cylinder secured to the second flange of the hammer;

a first valve pneumatically coupled to the chamber of the first pneumatic cylinder, wherein the first valve controls pressurized gas entering the chamber from a pressurized gas source and exiting the chamber;

a second valve pneumatically coupled to the chamber of the second pneumatic cylinder, wherein the second valve controls pressurized gas entering the chamber from the pressurized gas source and exiting the chamber;

a first pneumatic contact sensor configured for sensing the guide tube at a bottom position;

a second pneumatic contact sensor configured for sensing the guide tube at a top position;

a first planar element comprised of a polymer, the first planar element coupled to an L-bracket coupled to the sleeve;

a pneumatic controller fastened to the first planar element so as to isolate the pneumatic controller from vibrations of the sleeve and hammer, the pneumatic controller pneumatically coupled with the first and second pneumatic contact sensors, the first and second valves, and the pressurized gas source, the pneumatic controller configured for:

a) detecting, via the first pneumatic contact sensor, that the guide tube is at the bottom position;

b) activating the first and second valves to route pressurized gas from the pressurized gas source to the chambers of the first and second pneumatic cylinders, thereby moving the rods of the first and second pneumatic cylinders upwards, and causing the hammer to rise upwards;

c) detecting, via the second pneumatic contact sensor, that the guide tube is at the top position;

d) activating the first and second valves to expel pressurized gas from the chambers of the first and second pneumatic cylinders, thereby causing the rods of the first and second pneumatic cylinders to fall downwards, and the hammer to strike the sleeve and drive the piling downwards; and e) repeating steps a) through d).

18. A piling hammer, comprising:

a sleeve comprising a hollow element having a closed top end and an open bottom end configured for securely fitting around a top end of a piling, the sleeve including a first and second flange extending outwards from each side of the sleeve;

a guide rod extending upwards from the sleeve;

a hammer located on top of the sleeve, the hammer having a weight of at least 300 pounds, the hammer including a first and second flange extending outwards from each side of the hammer;

a guide tube extending downwards from the hammer and configured such that a top portion of the guide rod is located within the guide tube;

a first pneumatic cylinder comprising a chamber on one end and a rod on another end, the chamber secured to the first flange of the sleeve and the rod secured to the first flange of the hammer;

a second pneumatic cylinder comprising a chamber on one end and a rod on another end, the chamber of the second pneumatic cylinder secured to the second flange of the sleeve and the rod of the second pneumatic cylinder secured to the second flange of the hammer;

a first valve pneumatically coupled to the chamber of the first pneumatic cylinder, wherein the first valve controls pressurized gas entering the chamber from a pressurized gas source and exiting the chamber;

a second valve pneumatically coupled to the chamber of the second pneumatic cylinder, wherein the second valve controls pressurized gas entering the chamber from the pressurized gas source and exiting the chamber;

two pneumatic contact sensors configured for sensing a position of the guide tube;

a planar element comprised of a polymer, the planar element coupled to at least one bracket coupled to the sleeve;

a pneumatic controller fastened to the planar element so as to isolate the pneumatic controller from vibrations of the sleeve and hammer, the pneumatic controller pneumatically coupled with each of the two pneumatic contact sensors, the first and second valves, and the pressurized gas source, the pneumatic controller configured for:

a) detecting, via a first of the two pneumatic contact sensors, that the hammer is at a bottom position by detecting a position of the guide tube;

b) activating, via a pressurized gas line, the first and second valves to route pressurized gas from the pressurized gas source to the chambers of the first and second pneumatic cylinders, thereby moving the rods of the first and second pneumatic cylinders upwards, and causing the hammer to rise upwards;

c) detecting, via a second of the two pneumatic contact sensors, that the hammer is at a top position by detecting a position of the guide tube;

d) activating, via the pressurized gas line, the first and second valves to expel pressurized gas from the chambers of the first and second pneumatic cylinders, thereby causing the rods of the first and second pneumatic cylinders to fall downwards, and the hammer to strike the sleeve and drive the piling downwards; and e) repeating steps a) through d).

* * * * *